United States Patent [19]

Bricmont

[11] 4,131,914

[45] Dec. 26, 1978

[54] METHOD AND APPARATUS FOR INSPECTING REFRACTORY LINING IN COKE OVEN CHAMBERS AND THE LIKE

[75] Inventor: Francis H. Bricmont, Pittsburgh, Pa.

[73] Assignee: Bricmont & Associates, Inc., Pittsburgh, Pa.

[21] Appl. No.: 719,858

[22] Filed: Sep. 2, 1976

Related U.S. Application Data

[63] Continuation-in-part of Ser. No. 615,988, Sep. 23, 1975, abandoned.

[51] Int. Cl.[2] ..... H04N 7/18

[52] U.S. Cl. ..... 358/100; 358/210; 358/222; 358/229

[58] Field of Search ..... 358/100, 101, 93, 210, 358/222, 229

[56] References Cited

U.S. PATENT DOCUMENTS

| | | | |
|---|---|---|---|
| 3,145,636 | 8/1964 | Hall | 358/100 |
| 3,229,577 | 1/1966 | Ellinger | 358/100 |
| 3,472,949 | 10/1969 | Banning | 358/100 |
| 3,504,122 | 3/1970 | Ratliff | 358/210 |
| 3,518,372 | 6/1970 | Johns | 358/222 |
| 3,718,758 | 2/1973 | Ponghis | 358/100 |
| 3,761,623 | 9/1973 | Hara | 358/100 |
| 3,764,736 | 10/1973 | Kosky | 358/100 |
| 3,852,527 | 12/1974 | McQuivey | 358/100 |
| 3,862,359 | 1/1975 | McCullough | 358/100 |
| 3,930,942 | 1/1976 | Thome | 358/100 |

*Primary Examiner*—Howard W. Britton

*Attorney, Agent, or Firm*—Thomas H. Murray; Clifford A. Poff

[57] ABSTRACT

The refractory lining of a high temperature chamber such as a coke oven chamber is inspected after a coke pushing operation and before coal is charged into the chamber by using a pusher ram to move a television camera located within an enclosure having water cooling pipes in the side walls thereof to provide a thermally-protective environment for the camera. The lens for the camera which projects from a side wall of the enclosure is air-cooled. The enclosure for the camera is rotatably positioned and vertically displaced relative to an L-shaped bracket used to support the enclsoure upon the coke engaging end of the pusher ram. In addition to displaying the video signal produced by the camera on a monitor, the video signal is also recorded to evaluate the surface condition of the refractory lining at a later period of time.

24 Claims, 6 Drawing Figures

FIG. 1.
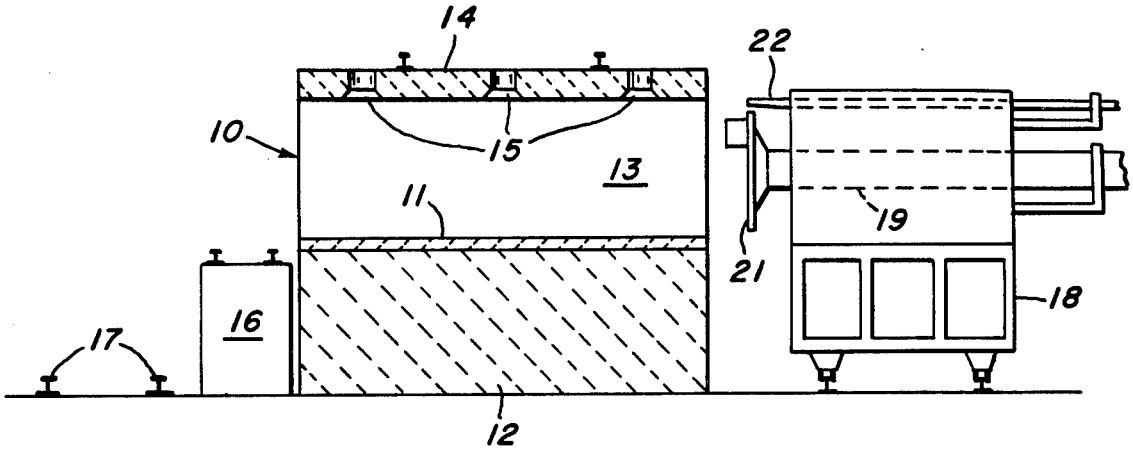
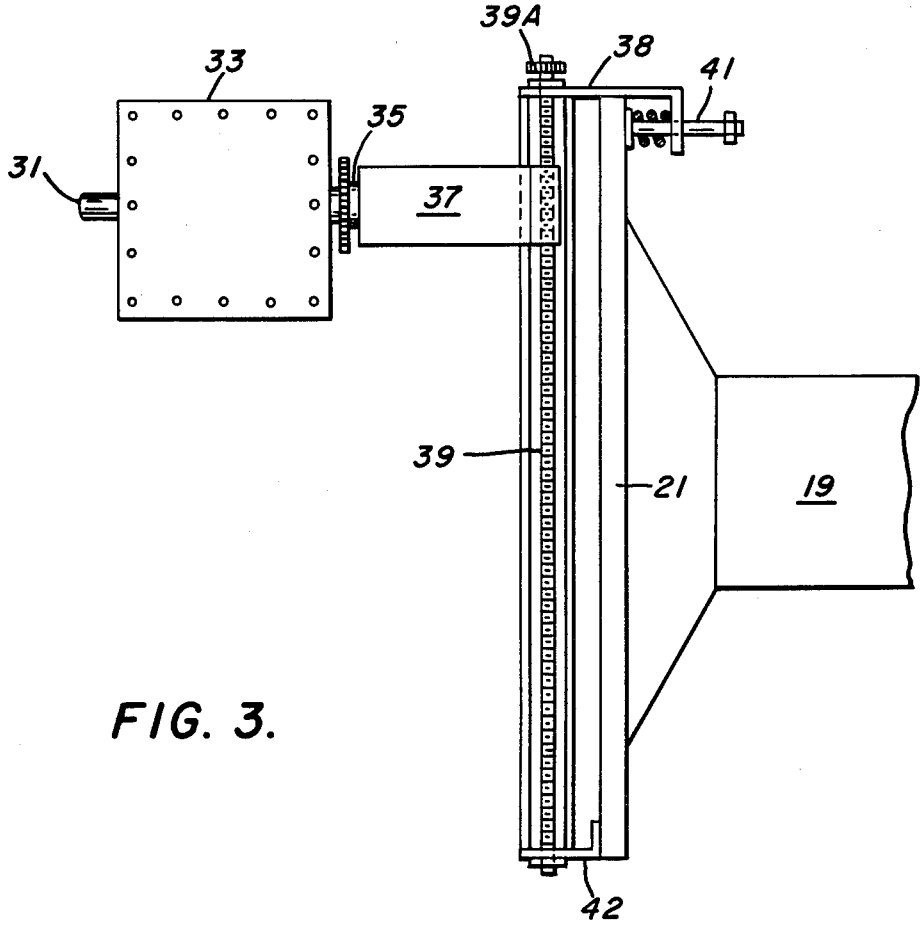
FIG. 3.

METHOD AND APPARATUS FOR INSPECTING REFRACTORY LINING IN COKE OVEN CHAMBERS AND THE LIKE

CROSS-REFERENCE TO RELATED APPLICATION

This application is a continuation-in-part of application Ser. No. 615,988, filed Sept. 23, 1975, now abandoned.

BACKGROUND OF THE INVENTION

This invention relates to a method and apparatus for inspection of the refractory lining of a high temperature chamber such as is commonly employed in coking chambers of a battery of coke ovens, pneumatic steel treatment vessels, reheat furnaces for metallic workpieces and the like. More particularly, the present invention is addressed to the inspection of such a refractory lining while at a highly heated state by transmitting video signals to a remote location produced by a television camera that is moved along such refractory lining while the camera is located within a thermally-protective environment formed by an enclosure.

A typical coking chamber in a coke oven battery of present-day designs is approximately 2 feet wide, 12 to 18 feet high and 40 to 60 feet long. In a coke oven battery, the coking chambers except those at each end of the battery have a coking chamber at each side thereof. When a given coking chamber is pushed, the adjacent coking chambers at each side thereof have coal charges that have been advanced approximately midway through the coking process. While inspection of the refractory lining of a coking chamber is extremely important, it must be carried out within a relatively short period of time to not only minimize production losses but also to avoid critical temperature imbalances particularly since there is an empty coke oven chamber having side walls which are an integral part of the heating flues employed to heat the adjacent coking chambers.

Presently, the inspection of a coking chamber takes place immediately after the coke has been pushed into a transfer car at the coke side by a ram supported at the machine side. An inspector then views the emptied oven chamber from either the coke side or the machine side. The time available to the inspector for viewing the refractory lining is usually very short because the inspector is exposed to intense thermal radiation from the oven. In this respect, a coking chamber is heated to relatively high temperatures and within the range of 1200° F to 2100° F. The inspector, therefore, quickly views the internal refractory surface of the oven chamber to observe any deterioration of the refractory surface. The condition of the refractory surface is usually described in writing after the inspection by its appearance to the individual inspector. Such an inspection procedure is critically dependent upon the experience of the inspector and his ability to describe in terms meaningful to others exactly what he, in fact, observed during the relatively short inspection period. Moreover, this inspection procedure is further complicated by optical refraction caused by hot gases within the coking chamber during the inspection viewing period. Thus, extremely important information for timely maintenance and pollutant-free operation of a coke oven battery is presently compiled in a very rudimentary manner. While the foregoing description has been addressed to the problems and difficulties associated with the inspection of a refractory surface of a coke oven chamber, the present invention is equally applicable to the inspection of the refractory lining of other chambers including but not limited to vessels for pneumatic steel refining, furnaces for reheating metallic workpieces and the like.

SUMMARY OF THE INVENTION

It is an object of the present invention to provide an inspection method and apparatus for viewing the internal refractory surface of a chamber while at a relatively high temperature in a manner which will materially reduce the time required for such inspection while providing more accurate and detailed inspection information regarding the condition of the refractory surfaces.

It is a further object of the present invention to provide a method and apparatus for inspecting the refractory lining of a high temperature chamber by moving a television camera in spaced-apart relation along the refractory lining while the camera is located within a thermally-protective environment provided by an enclosure that includes means for cooling the optical lens of the camera and in a manner whereby the camera is remotely positioned and controlled at a location which preferably includes a television monitor for the immediate viewing of the video signal produced by the television camera.

It is another object of the present invention to provide an inspection method and apparatus including a television camera arranged within a thermally-protective environment provided by a water-cooled enclosure that is rotatably and linearly displaced while carried by a movable support member.

More specifically, according to the present invention, there is provided an inspection apparatus for inspecting the refractory lining of a high temperature chamber, the apparatus including the combination of a movable member supported externally of the chamber for traveling movement in a direction along the refractory lining within the chamber, an enclosure including side walls normally forming a substantially closed compartment, the enclosure including means for maintaining a thermally-protective environment within the compartment thereof, means carried within the compartment for producing a video signal corresponding to at least a portion of the refractory lining, such means including an optical lens exposed to the refractory lining by an opening in the side wall of the enclosure, means for cooling the optical lens, means for positioning the aforesaid enclosure and/or the aforesaid means for producing a video signal while supported by the movable member, and receiver means for displaying the video signal at a location remote to the refractory lining.

The inspection method of the present invention includes the steps of producing a thermally-protective environment for a television camera which includes cooling the optical lens of the camera, displacing the thermally-protective television camera in a spaced-apart relation along the refractory lining of the high temperature chamber, transmitting a video signal corresponding to a first side wall portion of the refractory lining to a location externally of the high temperature chamber by directing the lens for the camera toward the refractory lining, displaying the video signal on a television receiver means, repositioning the thermally-protected camera, thereafter transmitting a video signal corresponding to a second side wall portion of the refractory lining to a location externally of the high temperature chamber, and displaying the video signal corresponding to the second side wall portion of the refractory lining on a television receiver means.

The method of the present invention is further characterized by recording the video signal provided by the television camera on a magnetic storage medium during each one of a plurality of successive periods between operation of the high temperature chamber.

These features and advantages of the present invention as well as others will be more readily understood when the following description is read in light of the accompanying drawings, in which:

FIG. 1 is an elevational view, in section, of a typical coke oven chamber to undergo inspection according to the method and apparatus of the present invention;

FIG. 3 is an elevational view of the inspection apparatus shown in FIG. 2;

Figure 2:
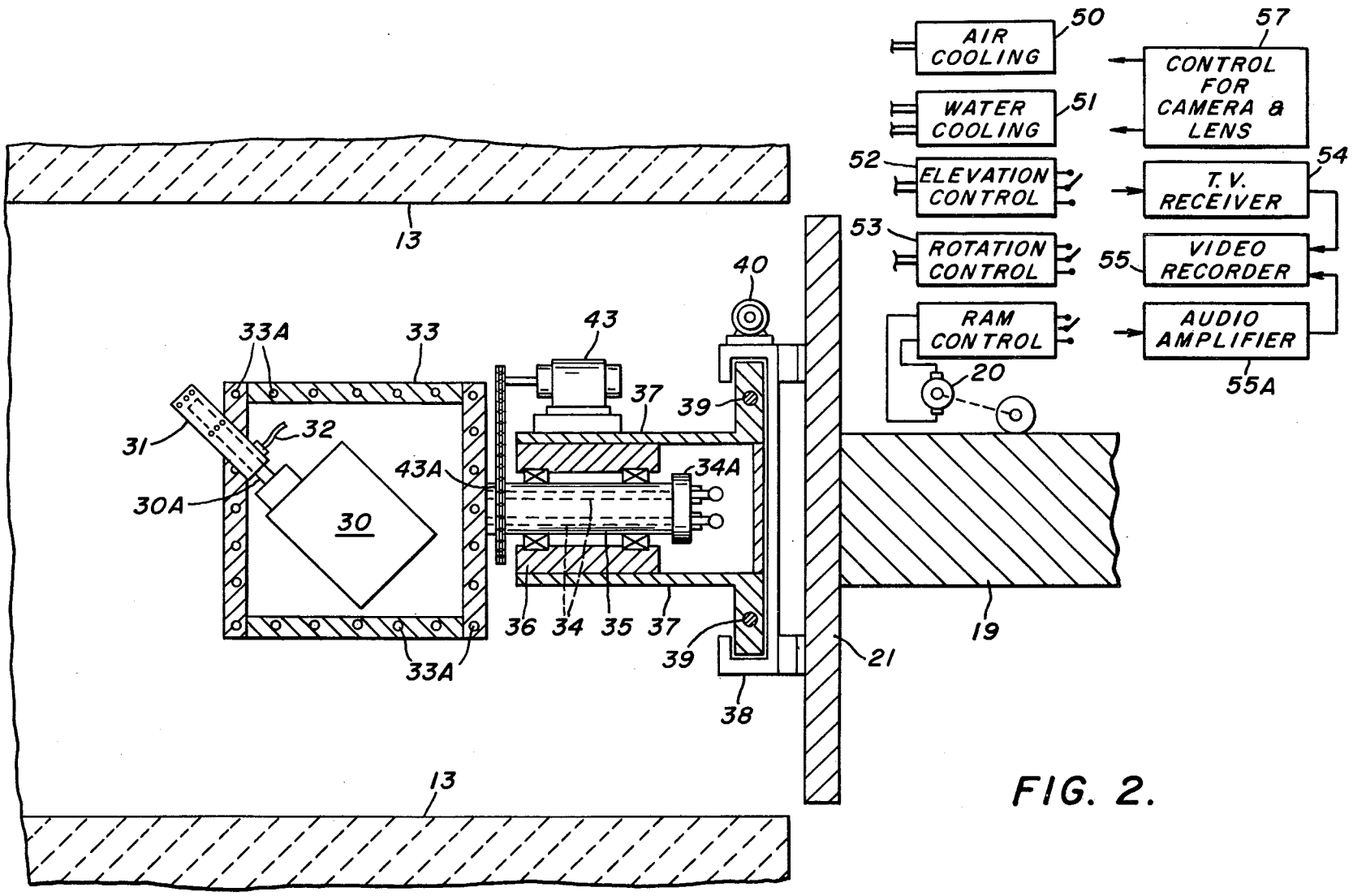
FIG. 2 is a plan view, in section, of the inspection apparatus according to the present invention.

FIG. 1 illustrates a coking chamber 10 which extends in a generally horizontal direction and forms one of a plurality of spaced-apart and side-by-side coking chambers in a coke oven battery. The coking chamber 10 includes a refractory hearth 11 located above generators 12 used for regeneratively heating the coking chamber in a manner which is well known in the art. The chamber 10 is closed at its opposite ends by removable doors, not shown. The coking chamber has vertical side walls 13 formed by courses of refractory brick or other forms of refractory material used to transmit heat from heating flues that extend between adjacent oven chambers. A roof 14, also made of refractory material, has charging openings 15 for feeding coal into the oven chamber from a coal charging car movable along the oven roof. A coke bench 16 is located above the ground floor at the coke side of the oven. The coke bench 16 includes rails for supporting a coke guide machine, not shown, to guide the mass of coke pushed from the oven chamber into a coke transfer car after positioning along rails 17 at the coke side of the oven chamber. At the machine side of the coking chamber, which is opposite the coke side, there is provided rails which carry a pushing machine 18 that includes a ram 19 and a drive having a motor 20 to move a ram plate 21 into engagement with the mass of coke in the oven chamber. The ram is usually constructed in a manner such that the coke engaging face of the ram is horizontally displaced in the coke chamber to the coke side thereof. The pusher machine also includes a leveling bar 22 used in a well-known manner to level a coal charge in an oven chamber.

Turning, now, to FIGS. 2 and 3, according to the present invention the ram 19 is used to support and traverse a television camera 30 within the coking chamber for inspection of the refractory lining thereof while in a highly heated state. Typically, the inspection operation is carried out immediately after a coke pushing operation. The camera is protected from the adverse environment within the coking chamber, particularly the high temperature that may be of the order of 2200° F during this period of time. The television camera is per se well known in the art. The camera has a remotely controllable zoom-type lens 30A that is surrounded by a pipe 31 coupled to an airline 32 for discharging air through openings in the side walls of the pipe to cool the lens. The television camera is supported within a box-like enclosure 33 that includes side walls containing spaced-apart and parallel fluid conducting pipes or lines 33A that communicate with similar fluid conducting lines in the top and floor walls. The lines 33A receive and discharge coolant water conducted by lines 34 that extend internally along a trunnion shaft 35 to a rotary union 34A. Other supply lines, not shown, are connected to the rotary union and extend along the ram 19 to the pushing machine.

The trunnion shaft 35 is rotatably supported by bearings carried in a bearing block 36 that is, in turn, supported by carrier arms 37. The carrier arms are received between guide plates forming part of an L-shaped support member 38. The carrier arms 37 have threaded bores that receive threaded shafts 39 that are rotated by sprocket wheels 39A coupled by a chain drive motor 40 carried by support member 38. The motor is employed to rotate shafts 39 which, in turn, displace the carrier arms 37 and trunnion shaft 35. In this way, the television camera is movably positioned vertically along the faceplate 21 of the ram. The L-shaped support member 38 includes a spring-biased plunger 41 adapted to engage the back surface of the pusher plate of the arm, as clearly shown in FIG. 3. The top member of the L-shaped support member is supported directly upon the top surface of the pusher plate. The L-shaped support member is removably supported by the ram and held in an outwardly-spaced relation from the face of the pusher plate by a spacer foot 42.

The enclosure 33 is rotatably positioned about a horizontal axis by a drive motor 43 that includes a sprocket wheel on its drive output shaft that is coupled by a chain to a sprocket wheel 43A on the trunnion shaft 35.

The pusher car 18 includes an operator station where controls for the apparatus and method of the present invention are provided. At this station, for example, there is included an air-coolant supply system 50 for the optical lens of the camera. A water-coolant supply system 51 is coupled to the lines 34 for circulation of coolant water in the passageway 33A of the enclosure. An elevation control 52 is used to control the operation of motor 40 and a rotation control 53 is coupled to the motor 43 to control rotation of the enclosure 33 and camera 30.

The video signal from the television camera is transmitted to a television receiver 54. The video signal is also delivered to a magnetic storage medium, preferably to a video recorder 55 that is connected to an audio amplifier 55A that supplies an audio input signal to the recorder for the identification of the particular oven chamber that is undergoing inspection as well as the particular time at which the inspection occurred. A camera and lens control 57 is connected to the television camera 30 and the zoom-type lens 30A for ON and OFF control and close inspection of a particular surface area of the refractory lining.

Figure 4:
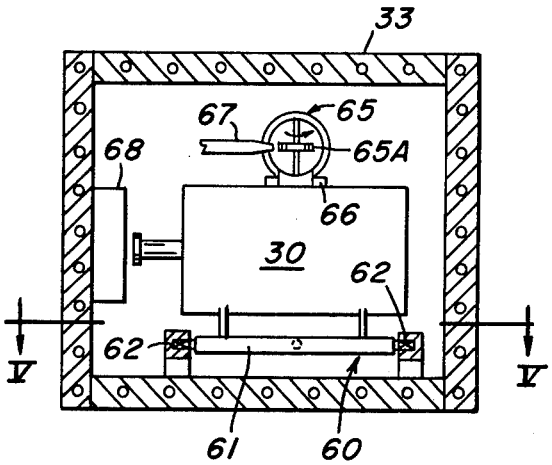
FIG. 4 is a plan view similar to FIG. 2 but illustrating modifications to the inspection apparatus according to the present invention.
Figure 5:
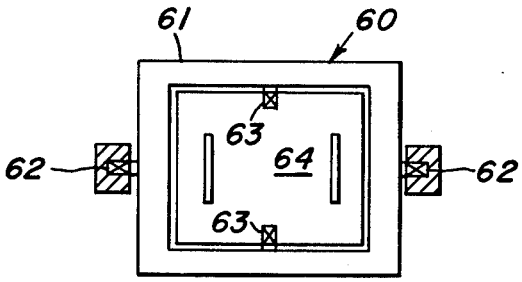
FIG. 5 is a sectional view taken along line V-V of FIG. 4.

FIGS. 4 and 5 illustrate a gyroscope mounting arrangement for support of the television camera 30 within the enclosure 33. A four-bearing gimbal platform 60 forms an attachment structure of the camera. The gimbal platform 60 includes an outer rectangular frame 61 having aligned bearing supports 62 at opposite sides of the frame supported by the side wall of the enclosure 33. The other opposite sides of the frame 61 carry aligned bearing supports 63 of an inner rectangular plate 64. One side of the television camera is attached to the plate 64. A gyroscope 65 is attached by a mounting plate 66 to the other side of the television camera. The gyroscope is operated pneumatically by directing a stream of air from a nozzle 67 onto a finned gyroscope wheel 65A to rotate it at a speed of, for example, 20,000 revolutions per minute. By this construction and arrangement of parts, mechanical shocks produced by the ram drive and movement of the ram are dampened or otherwise isolated from the television camera. In FIG. 4, the optical system for the television camera includes a viewing prism 68 which is cooled by a stream of air in a manner similar to that previously described for cooling the lens of the television camera. The viewing prism is employed to permit viewing of opposite side walls of a coke chamber at the same time.

Figure 6:
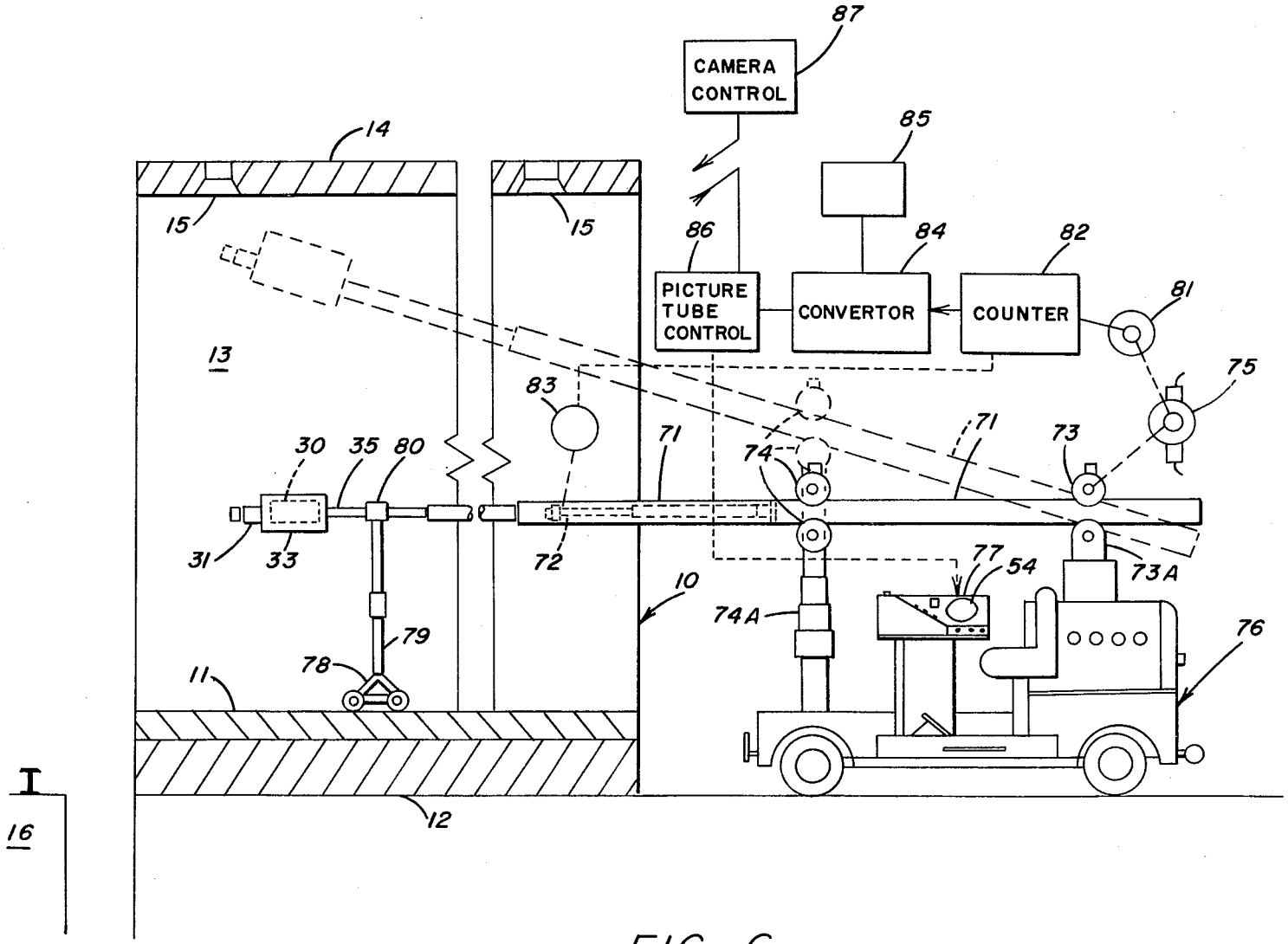
FIG. 6 is an elevational view of a further embodiment of the inspection apparatus according to the present invention.

In FIG. 6, there is illustrated a modified form of apparatus to carry out the inspection of a coke oven chamber while in its highly heated state. The various parts forming the coke oven chamber are identified with the same reference numerals as previously identified in regard to the coke oven chamber shown in FIGS. 1 and 2. Instead of employing the ram 19 as previously described to support and traverse the television camera within the coke oven chamber for inspection of the refractory lining thereof, the modification illustrated in FIG. 6 includes the use of an extendible boom on a wheeled vehicle for traversing the TV camera along the chamber walls within the coke oven chamber. It is to be understood that the previously-described television camera 30 within the box-like enclosure 33 and the various parts described in regard thereto are employed according to the embodiment of FIG. 6. The trunnion shaft 35 is coupled to the outer end of a telescopic boom 70. The boom includes a plurality of tubes 71 adapted to slide one within the other. A piston and cylinder assembly 72 located within the tubes 71 is coupled by its rod end to the outermost extending tube, and at its cylinder end, a clevis or similar type of connection is used to mount the assembly within the tube having the largest diameter. A motor-driven screw and nut may be used instead of the piston and cylinder assembly 72 to move the tubes in a telescoping manner. The boom 71 is supported between pairs of rollers 73 and 74. A motor 75 is coupled to one of the rollers 73 to advance and retract the boom along the truck 76 relative to a coke oven chamber. The boom is supported by the truck 76 which is steerable and self-powered. It is deemed unnecessary to specifically describe the well-known manner by which an industrial type truck is steered and powered.

The rollers 73 and 74 are carried at the forward and rearward portions of the truck by vertical supports 73A and 74A, respectively. The support 74A is vertically extendible by a piston and cylinder assembly, not shown, to raise the support rollers 74 above rollers 73. In this way, the TV camera 30 is raised at the end of the boom toward the roof 14 for close observation of the side walls 13 adjacent the roof 14. The boom extends from the truck in an inclined manner as shown by the phantom-line position. The supports 73A and 74A are located at one lateral side of the truck and opposite thereto a control console 77 is located. This console includes the TV receiver 54, video recorder 55, audio amplifier 55A and control for the camera and lens 57, all as previously described. Moreover, additional apparatus to be hereinafter described, is preferably included in the control console 77. A wheeled carriage 78 is connected by a vertical support post 79 which is, in turn, attached by a sleeve 80 to the trunnion shaft 35 for supporting the outer end of the boom 70. The wheeled carriage is moved upon the oven hearth 11 by the boom but lifted from the hearth when the boom is raised by rollers 74 as previously described. The wheeled carriage 78 and post 79 minimize cantilever forces imposed upon the truck as the boom is extended to traverse the TV camera along the entire length of the coke oven chamber. A position transducer is employed to provide an indication of the relative displacement of the TV camera within the coke oven chamber. Motor 75 is coupled to a pulse generator 81 which, in turn, delivers a pulse output signal to a counter 82. The pulse output signal corresponds to increments of a preselected distance through which the boom is extended. A similar pulse generator 83 is coupled to the rod end of piston and cylinder assembly 72 to detect incremental lengths through which the boom 70 is extended. The pulse outputs from both pulse generators 81 and 83 are fed to the counter 82. The output signal from the counter 82 is in the form of a signal corresponding to the actual displacement of the TV camera relative to a fixed position of the truck 76, i.e., at the machine side of the coke oven chamber. The output signal from counter 82 is fed to a converter 84 which may be a matrix arrangement of diodes or other well-known forms of conversion circuitry to an analog signal. This analog signal is fed to a digital display 85 and/or combined by the picture tube control circuit 86 for display by the monitor together with the video signal corresponding to the side wall of the coke oven chamber from the TV camera. The picture tube control 86 receives the output signal from the TV camera which is, in turn, coupled to a camera control circuit 87. Because of the relatively narrow width of a coke oven chamber according to present-day designs, i.e., 2 feet as previously described, to enable the production of a meaningful video display of a side wall of the coke oven chamber on a monitor, the optics for the TV camera should be carefully chosen. In this regard, suitable state-of-the-art lenses may be used with the standard 525-scan line camera. Remote control of a mirror or prism in front of the camera lens will permit viewing opposite side walls of the coke oven chamber at different times. To achieve a display with a very high resolution, a 1050-scan line TV camera and video display monitor may be used whereby the resolution is increased by a factor of 4. A 1050-scan line camera and display monitor are well known in the art and commercially available in the industry.

The wheeled truck 76 and boom 70 for supporting the TV camera while located within the protective environment of the enclosure 33 enable the inspection of a coke oven chamber at any desired period of time without requiring the use of the pusher ram as employed according to the embodiments of FIGS. 1–5. In this regard, the pusher car is commonly employed to effect pushing operations with a number of coke oven chambers forming part of a battery. The use of the ram for inspection purposes may be unacceptable in certain instances. Moreover, the residence time by the ram within a given coke oven chamber during a coke pushing operation is usually relatively short so that the ram does not become distorted by the intense heat within the coke oven chamber. Since the ram is expensive and an indispensable part of the coke oven battery, its use to carry out inspection operations may be objectionable but this is overcome by using the wheeled truck and boom illustrated in FIG. 6.

It will be apparent to those skilled in the art in view of the foregoing that other forms of apparatus may be employed to position a television camera within a heated coking chamber or the like with equal success. It is preferred that the camera be capable of rotation through 360° to permit viewing of the roof, side walls and the hearth of the oven chamber. Vertical indexing of the camera by the motor-driven screws permits viewing of different portions of the side walls as the pusher is moved forward and backward horizontally along the oven chamber. During the inspection of the refractory lining, the camera can readily be positioned to more closely observe suspected damaged areas of the refractory lining by either employing the zoom control of the lens or by positioning the camera and the thermally-protective closure more closely to the refractory lining.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. An inspection apparatus for inspecting the refractory lining in a high temperature chamber of a coke oven, a pneumatic steel treatment vessel, a reheat furnace for metallic workpieces and the like before and/or after treating the burden therein, said apparatus including the combination of:

a movable member to advance within said chamber in a direction along the refractory lining thereof, support means externally of said chamber to carry said movable member, an enclosure including side walls normally forming a substantially closed compartment, said enclosure being supported by said movable member for movement within said chamber, said enclosure including means for maintaining a thermally-protective environment within the compartment thereof, drive means coupled to said movable member to displace said enclosure along the refractory lining of said chamber, means carried within the compartment of said enclosure for producing a video signal corresponding to at least a portion of said refractory lining, said means including an optical lens exposed to the refractory lining through an opening in the side wall of said enclosure, means for cooling said optical lens, means supported by said movable member to adjustably position said means for producing a video signal, and receiver means for displaying the video signal produced by the first said means and corresponding to at least a portion of said refractory lining.

2. The inspection apparatus according to claim 1 further comprising recorder means for receiving said video signal.

3. The inspection apparatus according to claim 1 wherein said means for maintaining a thermally-protective environment within said compartment includes fluid conducting lines carried by the side walls forming said enclosure.

4. The inspection apparatus according to claim 1 wherein said movable member includes an elongated ram for pushing coke from an oven chamber, and wherein said means to adjustably position includes a generally L-shaped bracket removably supported by the coke engaging end of said ram and carried thereby within an emptied oven chamber.

5. The inspection apparatus according to claim 4 further comprising means carried by said L-shaped bracket for rotatably positioning said enclosure about a horizontal axis.

6. The inspection apparatus according to claim 5 further comprising means for vertically displacing said enclosure along the end of said ram.

7. The inspection apparatus according to claim 1 wherein said movable member includes an extendible boom for carrying said enclosure, and wherein said support means includes truck means for supporting said boom externally of said chamber to move along the refractory lining within the chamber.

8. The apparatus according to claim 7 further comprising means for extending said boom within said chamber.

9. The apparatus according to claim 8 wherein said extendible boom includes a plurality of tubes adapted to slide one within the other.

10. The apparatus according to claim 8 further comprising position transducer means for detecting the displacement of said means for producing a video signal relative to said chamber.

11. The apparatus according to claim 8 further comprising a wheeled carriage to support said boom within said chamber.

12. The apparatus according to claim 8 further comprising means carried by said truck means to elevate said enclosure within said chamber.

13. The apparatus according to claim 8 further comprising rollers supported by said truck means to move said boom along said truck means relative to said chamber.

14. The apparatus according to claim 8 wherein said truck is steerable and self-powered, said receiver means being supported by said truck.

15. The inspection apparatus according to claim 1 wherein said means carried within the compartment of said enclosure for producing a video signal includes a television camera having a remotely-controlled optical lens.

16. The inspection apparatus according to claim 2 further comprising means coupled to said recorder means for delivering an audio input signal thereto.

17. The inspection apparatus according to claim 1 further comprising a gimbal platform to support said means for producing a video signal upon a side wall of said enclosure, and a driven gyroscope means carried by said means for producing a video signal.

18. The inspection apparatus according to claim 1 wherein said optical lens includes a viewing prism.

19. A method for inspecting the refractory lining of a high temperature chamber in a coke oven, a pneumatic steel treatment vessel, a reheat furnace for metallic workpieces and the like before and/or after treating the burden therein, said method including the steps of:

producing a thermally-protective environment for a television camera which includes cooling the optical lens of the camera, supporting the thermally-protected television camera externally of said high temperature chamber for adjustable movement of the camera within the chamber, displacing the thermally-protected television camera in a spaced-apart location along the refractory lining within the high temperature chamber only when the chamber is void of a burden, transmitting a video signal corresponding to a first side wall portion of the refractory lining to a location external of the high temperature chamber by directing the lens for the camera toward the refractory lining, displaying the said video signal on a television receiver means, repositioning the thermally-protected camera and thereafter transmitting a video signal from within the high temperature chamber corresponding to a second side wall portion of the refractory lining to a location external of the high temperature chamber, and displaying the video signal corresponding to the second side wall portion of the refractory lining on a television receiver means.

20. The method according to claim 19 including the further step of recording the video signals produced by said television camera on a magnetic storage medium during each one of a plurality of video signal transmissions which occur between successive periods of operation of the high temperature chamber.

21. The method according to claim 19 wherein said displacing the thermally-protected television camera includes advancing a movable ram while supporting the camera within the thermally-protected chamber.

22. The method according to claim 19 wherein said displacing the thermally-protected television camera includes extending a boom within the high temperature chamber while supporting the camera within the thermally-protected chamber.

23. The method according to claim 19 including the further steps of generating an electrical signal corresponding to the displaced distance of the television camera within the high temperature chamber, and using said electrical signal to provide a numerical display of said displaced distance.

24. The method according to claim 19 including the further step of using a steerable and self-powered truck while supporting an extendible boom for said displacing the thermally-protected television camera.

* * * * *